US010367299B2

(12) United States Patent
Yao et al.

(10) Patent No.: US 10,367,299 B2
(45) Date of Patent: Jul. 30, 2019

(54) PLUG CONNECTOR ASSEMBLY WITH AN UNLOCKING APPARATUS FOR UNLOCKING A LATCH

(71) Applicant: FOXCONN INTERCONNECT TECHNOLOGY LIMITED, Grand Cayman (KY)

(72) Inventors: Min Yao, Kunshan (CN); Xiao Fan, Kunshan (CN); Jun Chen, Kunshan (CN); Jerry Wu, New Taipei, CA (US)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/939,332

(22) Filed: Mar. 29, 2018

(65) Prior Publication Data

US 2018/0287295 A1 Oct. 4, 2018

(30) Foreign Application Priority Data

Mar. 29, 2017 (CN) ..... 2017 1 0197861
Mar. 29, 2017 (CN) ..... 2017 2 0319915

(51) Int. Cl.

| | |
|---|---|
| ***H01R 13/627*** | (2006.01) |
| *H01R 13/514* | (2006.01) |
| *H01R 13/633* | (2006.01) |
| *H01R 13/436* | (2006.01) |
| *H01R 12/72* | (2011.01) |

(52) U.S. Cl.

CPC ..... *H01R 13/6272* (2013.01); *H01R 12/721* (2013.01); *H01R 13/4361* (2013.01); *H01R 13/514* (2013.01); *H01R 13/633* (2013.01)

(58) Field of Classification Search

CPC ..... H01R 13/6272
USPC ..... 439/258, 352
See application file for complete search history.

(56) References Cited

U.S. PATENT DOCUMENTS 5,651,690 A * 7/1997 Klas ..... H01R 31/005 439/352
6,254,418 B1 * 7/2001 Tharp ..... H01R 13/6335 439/352

(Continued)

FOREIGN PATENT DOCUMENTS

CN 205070027 U 3/2016
CN 25595484 U 9/2016

*Primary Examiner* — Neil Abrams
(74) *Attorney, Agent, or Firm* — Wei Te Chung; Ming Chieh Chang

(57) ABSTRACT

An plug connector assembly for latching with a mating connector comprises an insulative body defining a latch apparatus on a side thereof, a cable extending along a front-to-back direction and rearwardly exposed to a rear end of the insulative body, and an unlocking assembly assembled on the insulative body and cooperate with the latch apparatus, and the latch apparatus defining a latching portion to latch with the mating connector, wherein the unlocking assembly comprises an actuator assembled on the insulative body and a operating portion connected to he actuator, and when the operating portion is operated, the actuator is derived by the operating portion to apply a force on the latch apparatus, so that the latching portion moves synchronously to release the locking with the mating connector.

17 Claims, 13 Drawing Sheets

(56) References Cited

U.S. PATENT DOCUMENTS

| | | | | |
|---|---|---|---|---|
| 6,920,275 | B2 * | 7/2005 | Chamorro | G02B 6/4439 385/137 |
| 7,651,361 | B2 * | 1/2010 | Henry | H01R 13/6272 439/352 |
| 8,025,519 | B2 * | 9/2011 | Handshaw | H01R 13/5845 439/352 |
| 8,475,197 | B2 * | 7/2013 | Zerebilov | H01R 13/6275 439/352 |
| 8,747,141 | B2 * | 6/2014 | Crain | H01R 13/6272 439/258 |
| 8,840,419 | B2 * | 9/2014 | Huang | H01R 13/6272 439/352 |
| 9,570,852 | B2 * | 2/2017 | Plamondon | H01R 13/6335 |
| 9,761,998 | B2 * | 9/2017 | De Dios Martin | H01R 13/6272 |
| 2005/0075001 | A1 * | 4/2005 | Shearman | H01R 13/6272 439/352 |
| 2018/0287295 | A1 * | 10/2018 | Yao | H01R 13/6272 |

* cited by examiner

PLUG CONNECTOR ASSEMBLY WITH AN UNLOCKING APPARATUS FOR UNLOCKING A LATCH

BACKGROUND OF THE INVENTION

1. Field of the Invention

The present invention relates to a plug connector assembly, and more particularly to a plug connector assembly with an unlocking apparatus for unlocking a latch thereof from a mating connector.

2. Description of the Related Art

China Patent No. 205070027, issued on Mar. 2, 2016, discloses a plug connector assembly, including an outer case, a printed circuit board assembled in the outer case, a collar member jacketing the outer case and a driving apparatus. The driving apparatus includes a latch member and a dive member. The latch member is assembled on the outer case and rotates between the locking position and the unlocking position. The drive member mates with the latch member and controls the latch member to rotate. The latch member includes a latching portion for latch with a mating connector. The outer case has a receiving slot for receiving a resilient portion of the drive member. The drive member pivots the latch member to press down on the resilient portion so that the resilient portion enters the receiving slot to unlock the latch member. The resilient portion and the collar member are separated such that the assembly operation of the plug connector assembly is complicated and difficult.

Therefore, a plug connector assembly with an improved unlocking apparatus.

BRIEF SUMMARY OF THE INVENTION

An object of the present invention is to provide an plug connector assembly with a unlocking apparatus for unlocking mating easily.

In order to achieve above-mentioned object, An plug connector assembly for latching with a mating connector comprises an insulative body defining a latch apparatus on a side thereof, a cable extending along a front-to-back direction and rearwardly exposed to a rear end of the insulative body, and an unlocking assembly assembled on the insulative body and cooperate with the latch apparatus, and the latch apparatus defining a latching portion to latch with the mating connector, wherein the unlocking assembly comprises an actuator assembled on the insulative body and a operating portion connected to he actuator, and when the operating portion is operated, the actuator is derived by the operating portion to apply a force on the latch apparatus, so that the latching portion moves synchronously to release the locking with the mating connector.

Other objects, advantages and novel features of the invention will become more apparent from the following detailed description of the present embodiment when taken in conjunction with the accompanying drawings.

DESCRIPTION OF PREFERRED EMBODIMENT OF THE INVENTION

Figure 1:
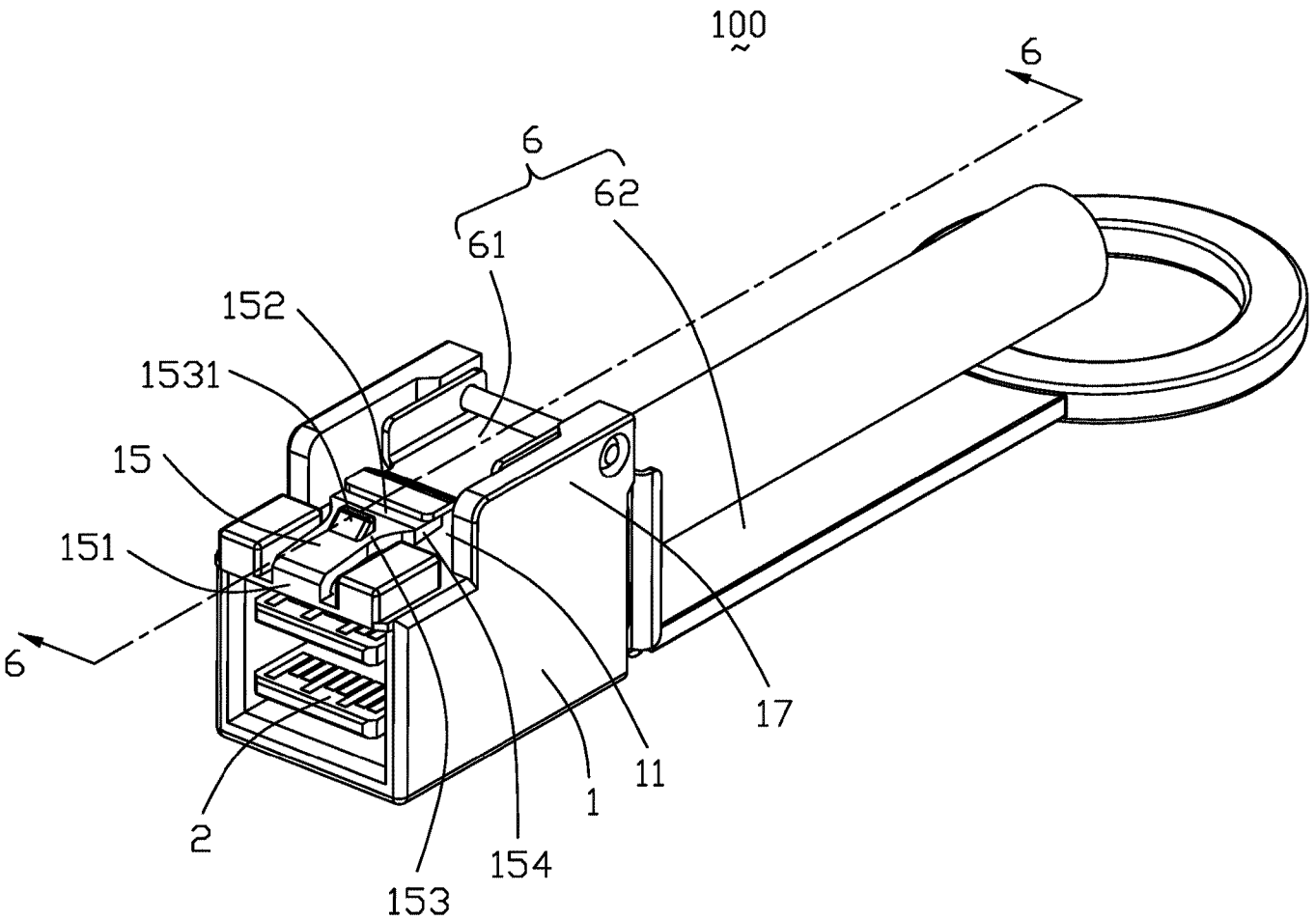
FIG. 1 is a perspective view showing an plug connector assembly in accordance with a first embodiment of the present invention.
Figure 2:
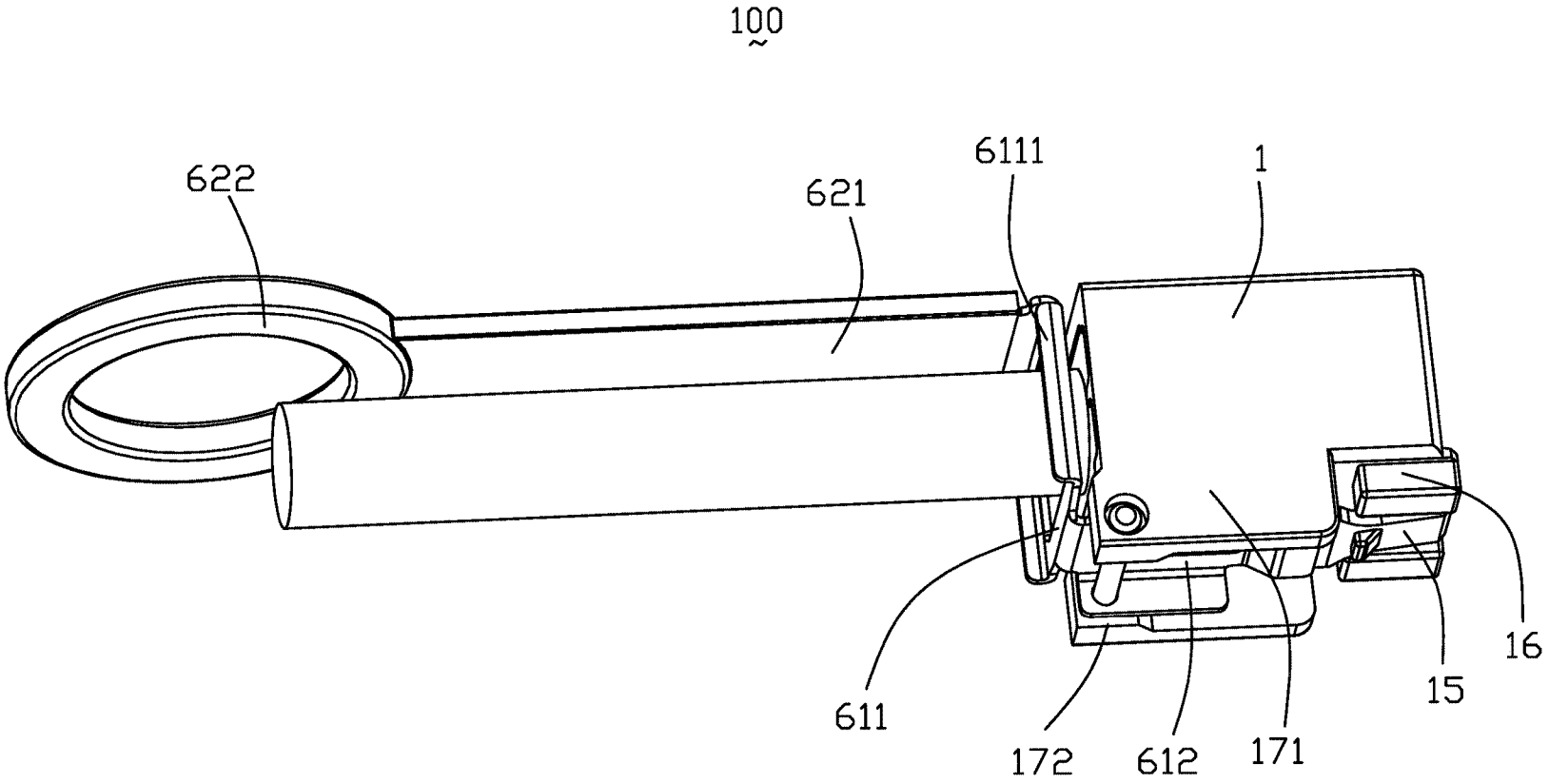
FIG. 2 is a perspective view similar to FIG. 1, but from a different perspective.
Figure 3:
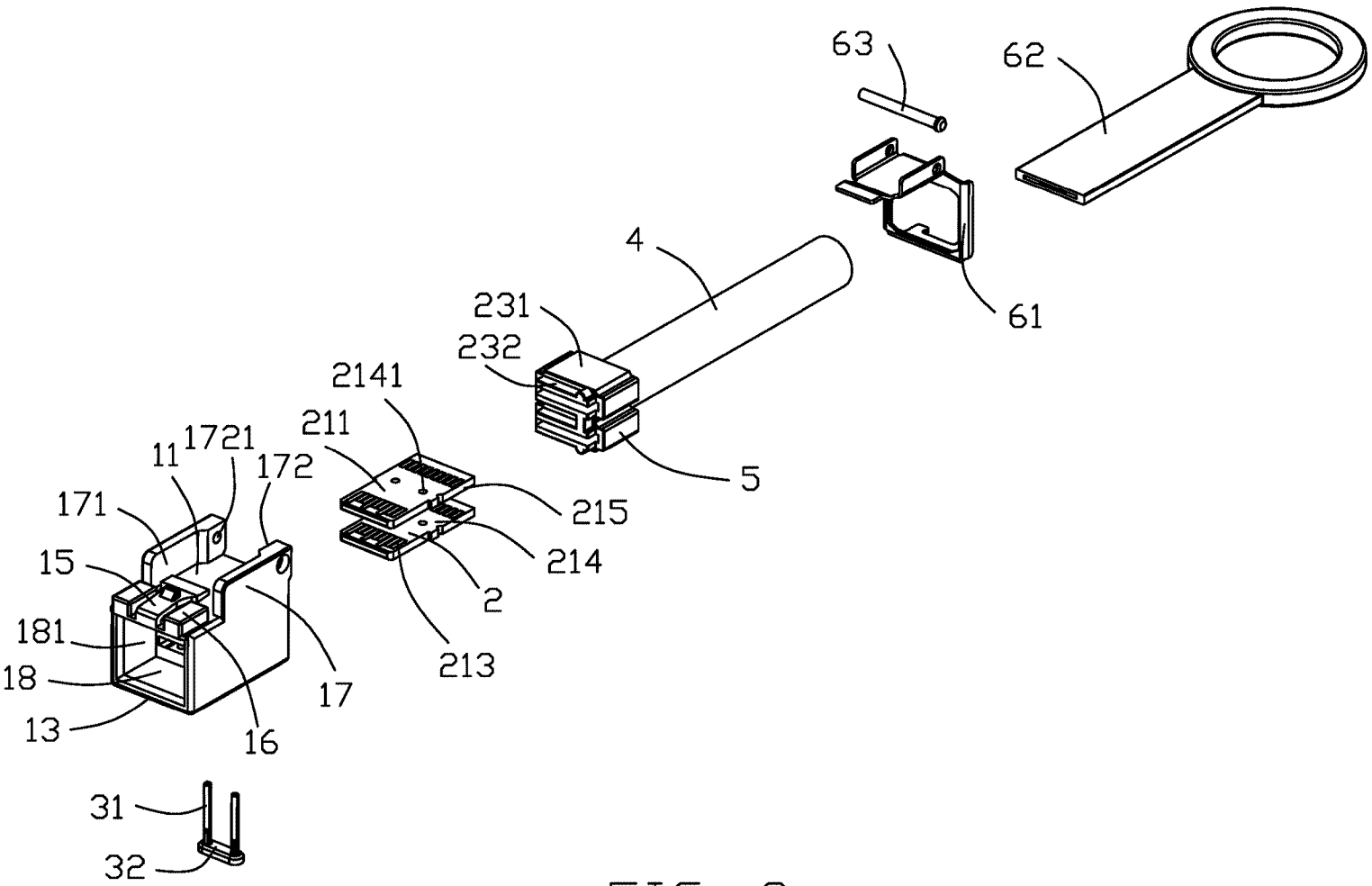
FIG. 3 is an exploded view showing the plug connector assembly shown in FIG. 1.
Figure 4:
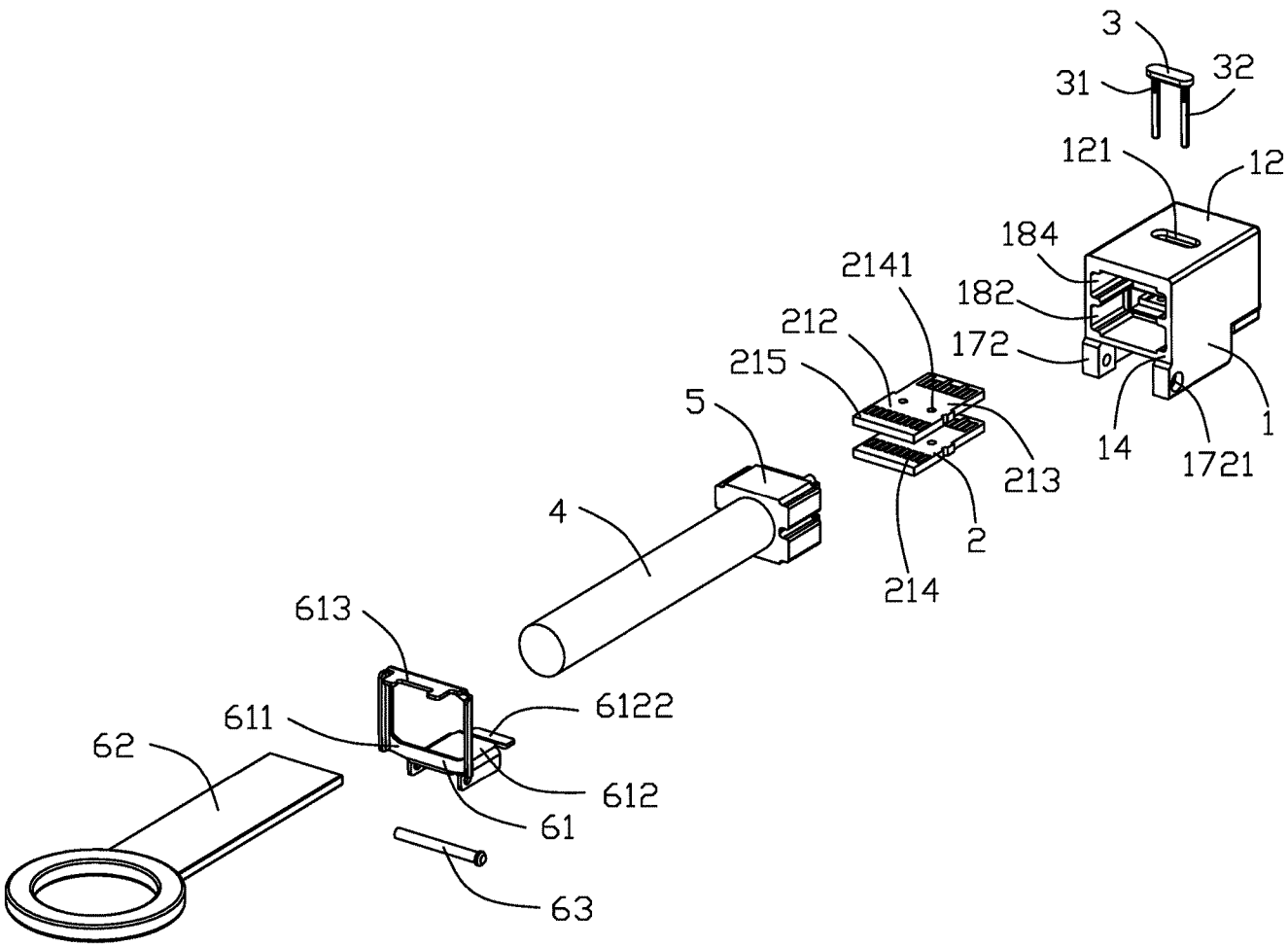
FIG. 4 is an exploded view similar to FIG. 3, but from a different perspective.
Figure 5:
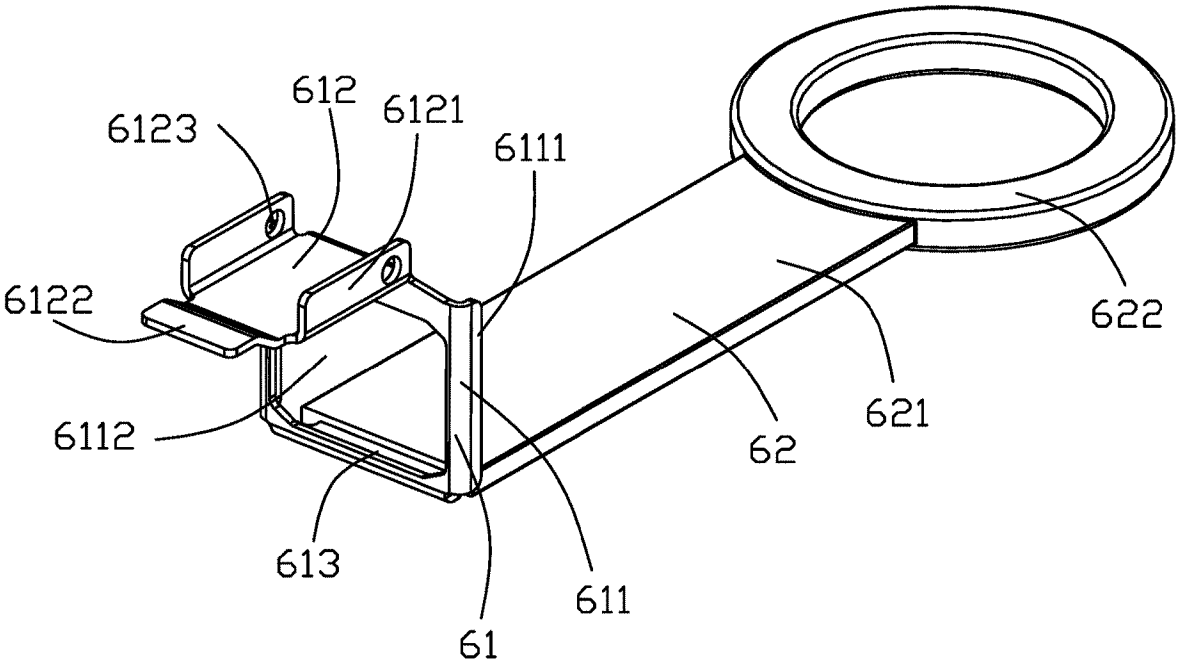
FIG. 5 is perspective view showing the latching member of the plug connector assembly shown in FIG. 1.
Figure 6:
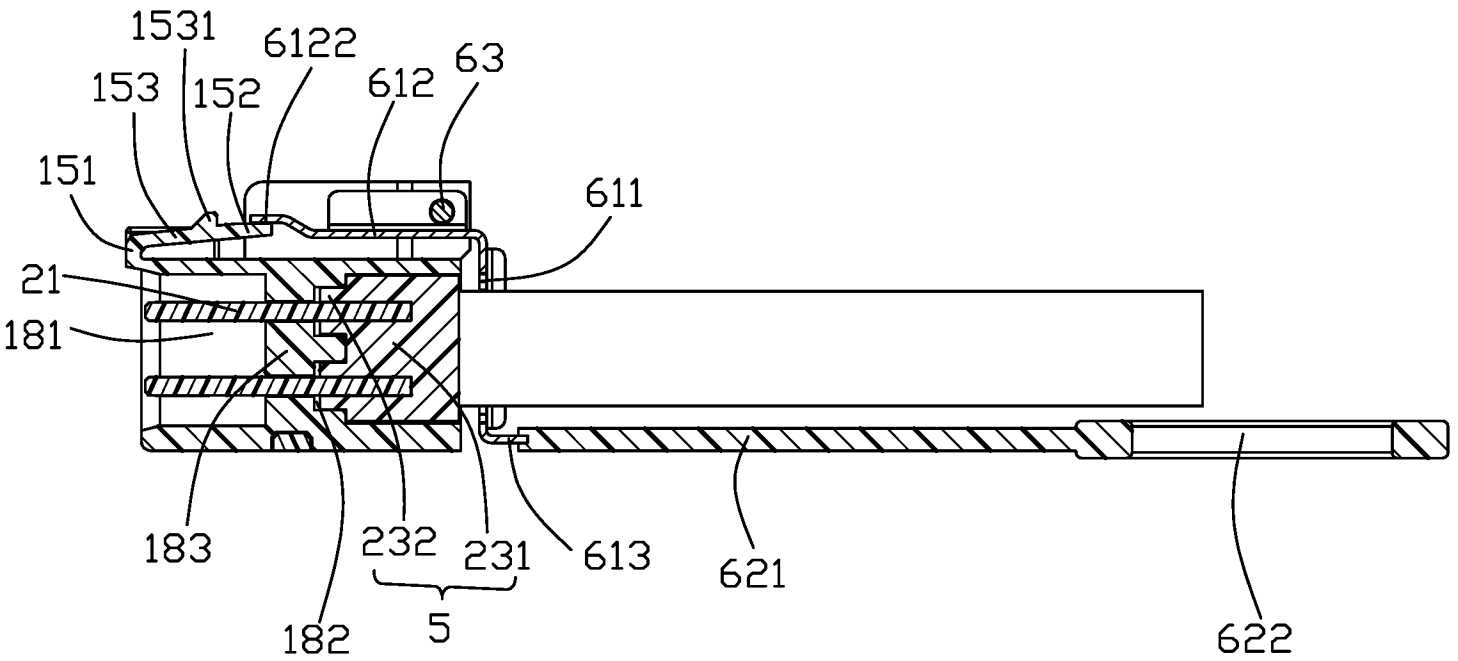
FIG. 6 is a section view showing the plug connector assembly shown in FIG. 1, along an A-A direction.
Figure 7:
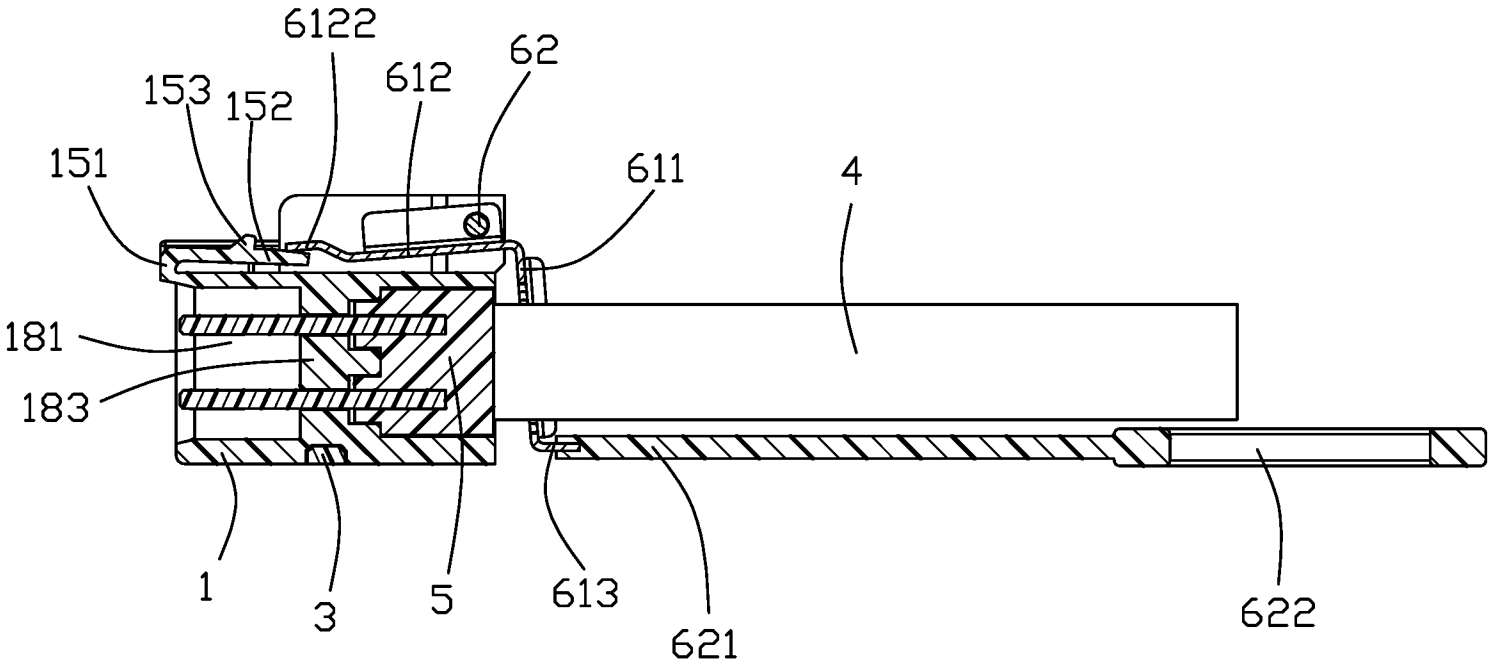
FIG. 7 is a section view along the A-A direction of the plug connector assembly shown in FIG. 1, when the latching member is acted.
Figure 8:
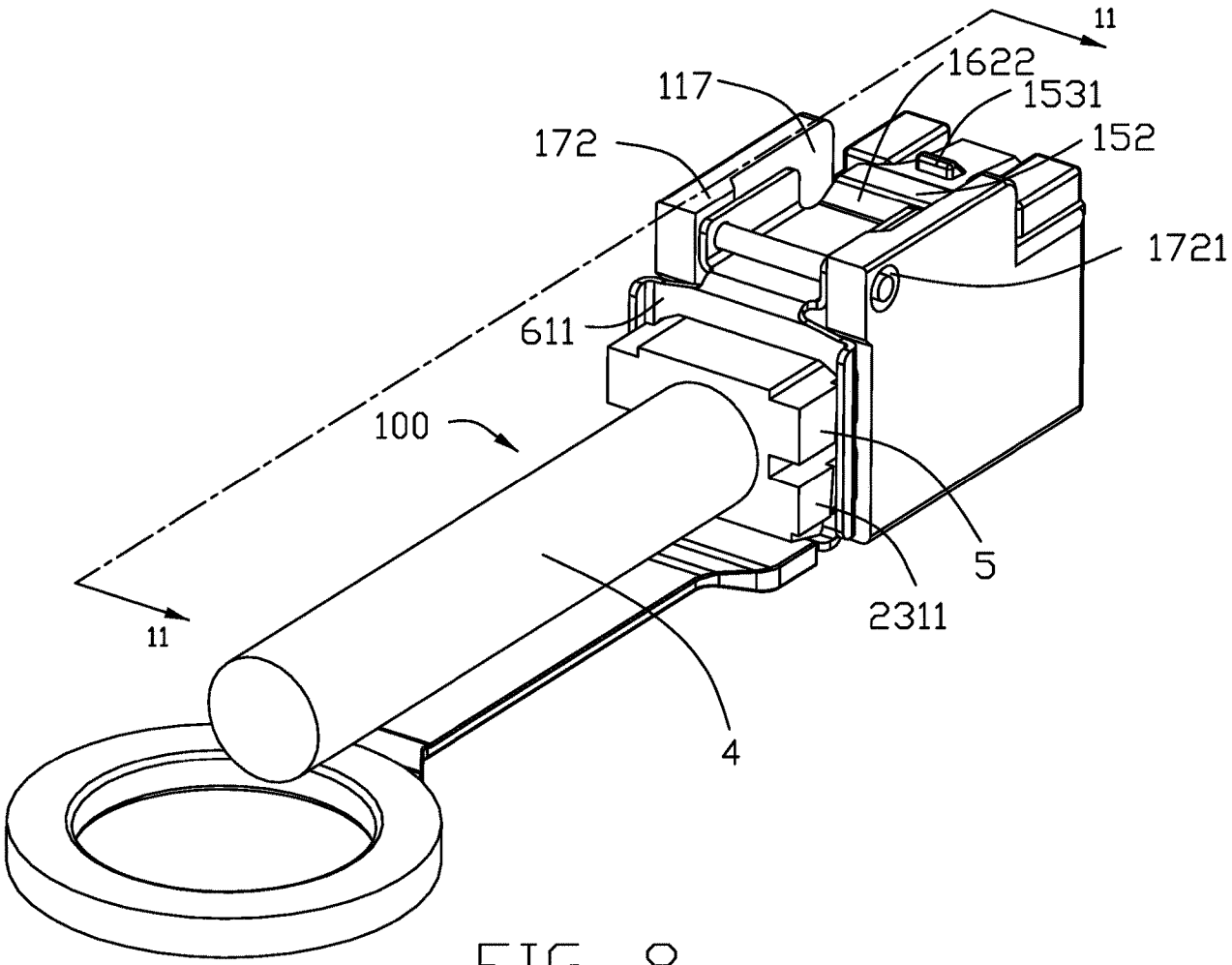
FIG. 8 is a perspective view showing a plug connector assembly in accordance with a second embodiment of the present invention.
Figure 9:
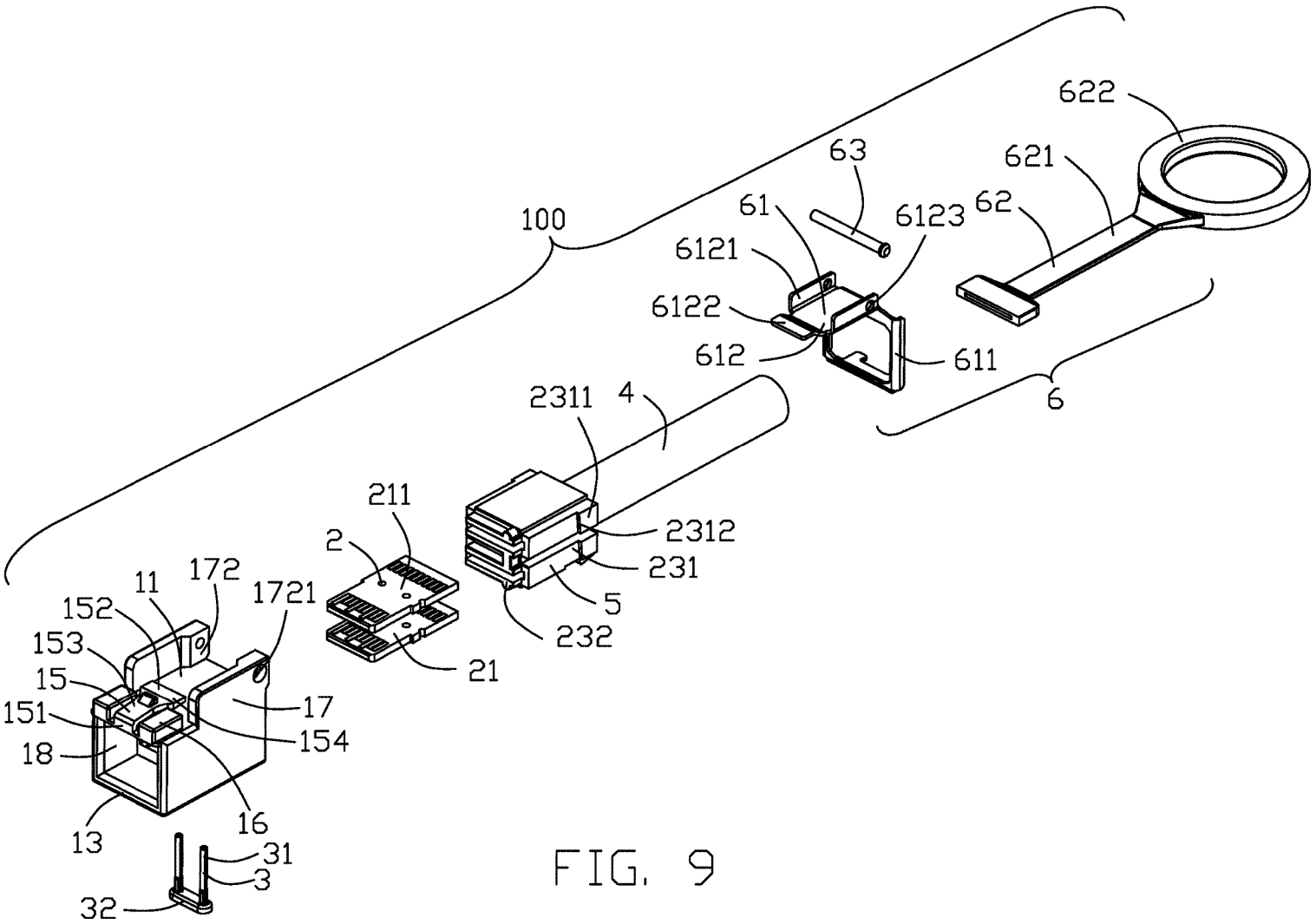
FIG. 9 is an exploded view showing the plug connector assembly shown in FIG. 8.
Figure 10:
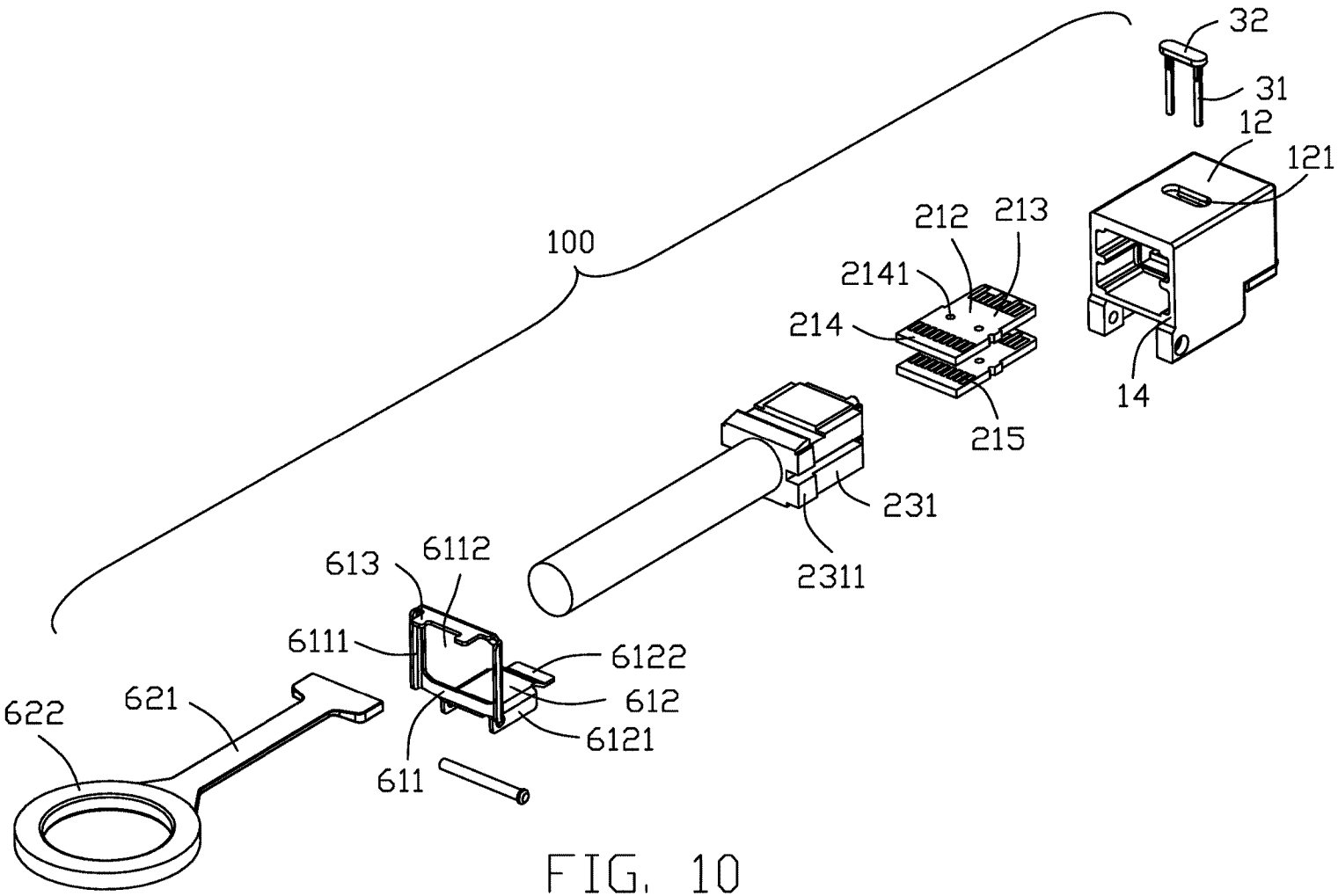
FIG. 10 is an exploded view similar to FIG. 9, but from a different perspective.
Figure 11:
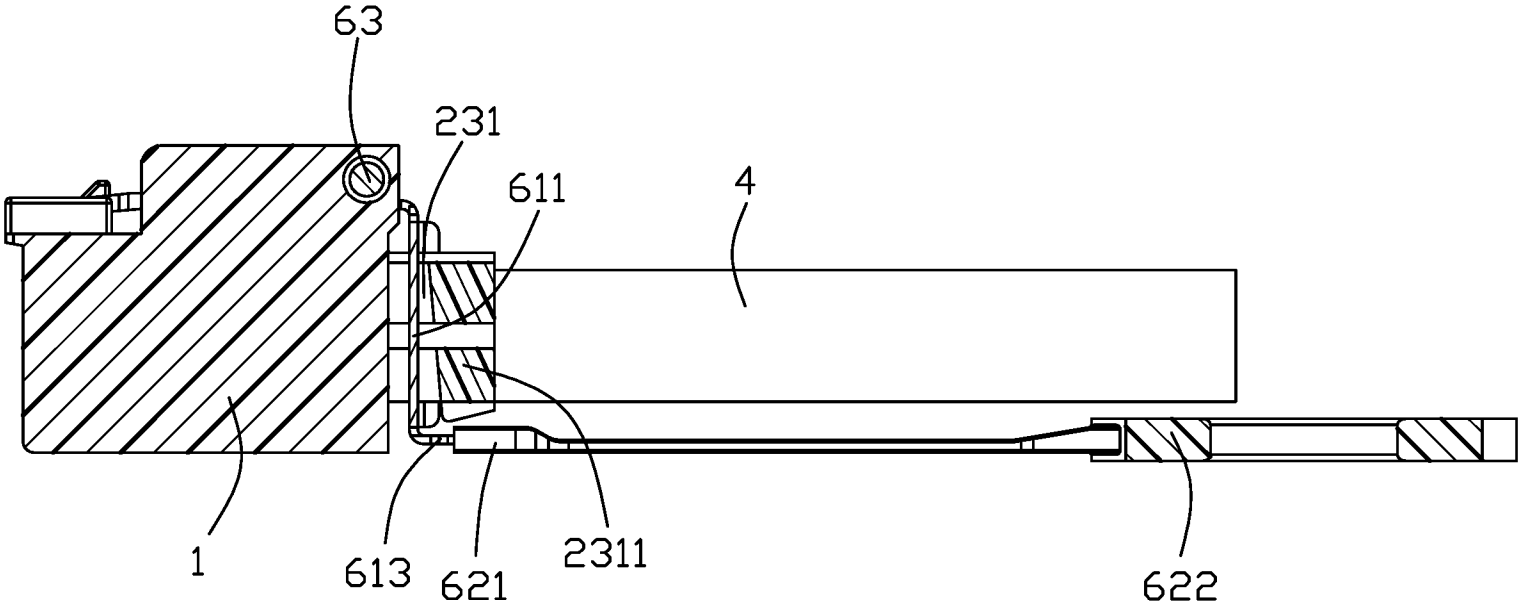
FIG. 11 is a section view of the plug connector assembly shown in FIG. 8, along a B-B direction.
Figure 12:
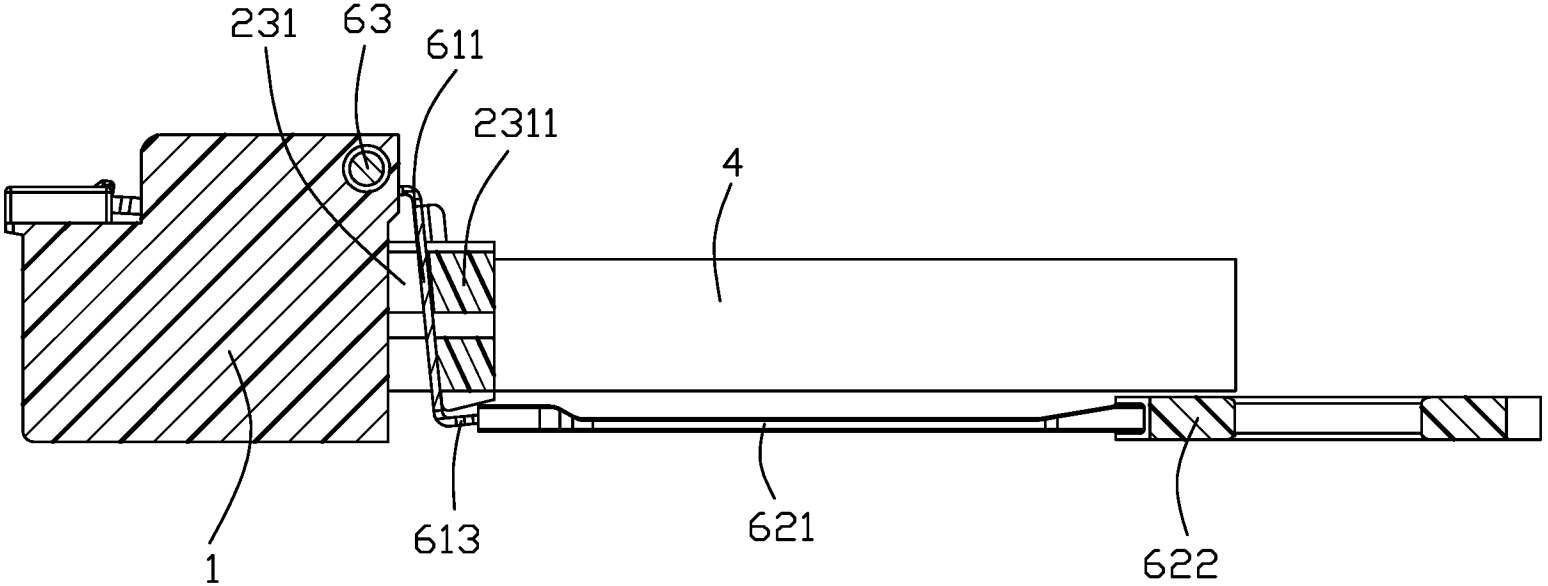
FIG. 12 is a section view of the plug connector assembly shown in FIG. 8, when the latching member is acted.

Reference will now be made to the drawing figures to describe a preferred embodiment of the present invention in detail.

Referring to FIG. 1 to FIG. 7, the plug connector assembly 100 is used to mat with a mating connector (not shown). The plug connector assembly 100 includes a insulative body 1 being of a rectangle shape, a printed circuit board module 2 received in the insulative body 1, a fixing member 3 for fixing the printed circuit board module 2 on the insulative housing 1, a cable 4 electrically connected with the printed circuit board module 2, a inner-mold member 5 enclosing the printed circuit board module 2 and the cable 4, and a unlocking assembly 6 assembled on the insulative body 1. In the present embodiment, the plug connector assembly 100 includes two printed circuit board modules 2, which are in a similar shape and stacked along a vertical direction. Each of the printed circuit board modules 2 includes a printed circuit board (PCB) 21.

The insulative body 1 defines a top surface 11, a bottom surface 12, a front surface 13 and a rear surface 14. The insulative body 1 includes a latching apparatus 15 set on the top surface 11, a pair of convex plates 16 located on two opposite sides of the latching apparatus 15 and a pair of mounting plate 17 located behind the convex plates 16. The insulative body 1 defines a receiving room 18 extending from the front surface 13 to the rear surface 14 along a front-to-back direction. The insulative body 1 defines a space plate 183 to separate the receiving room 18 to a front room 181 and a rear room 182. The front room 181 can also be regarded as a docking port formed on the front surface 13 of the insulative body 1. A left and a right inner side wall of the rear room 182 are provided with a space block 182 inwardly extending, for separate the rear room 182 into a top portion and a bottom portion, at the same time, to match the inner wall surface of the rear room 182 with the outer surface of the inner-mold 5 wherein the two stacked printed circuit board modules 2 assembled. The insulative body 1 defined a slot 121 on the bottom surface 12. The slot 121 is aligned with the space plate 183 in the vertical direction. A through hole (Not marked) is defined on the bottom surface of the slot 121 and extends into the space plate 183.

The latching apparatus 15 is integrally formed on the top surface 11 of the insulative body 1, and extends upwards from a front end of the insulative body 1 and then continues to extend backwards in a cantilevered manner. The latching apparatus 15 includes a connecting portion 151 upwardly extending from a front end of the top surface 11, a pressing portion 152 behind the connecting portion 151, a latching portion 153 connecting the connecting portion 151 and the pressing portion 152, wing portions 154 respectively extending from two opposite sides of a front end of the pressing portion 152. The latching portion 153 defines a latch block 1531 on a top surface thereof. The pressing portion 152 has a certain distance from the top surface 11, thus the latching apparatus 15 is cantilevered with respect to the insulative body 1. The latching apparatus 15 is elasticity, thus the latching portion 153 downwardly moves when operators press the pressing portion 152 and restores to original location when operators release pressing action. Engaging and disengaging of the plug connector assembly 100 and the mating connector is complied by operating the pressing portion 152 of the latching apparatus 15. The pair of convex plates 16 is displaced on two opposite sides of the latching portion 153 symmetrically, to prevent deflection of the plug connector assembly 100 when docked with a docking connector (not shown).

The mounting plate 17 includes a vertical portion 171 and a horizontal portion 172 inwardly extending from a rear end of the vertical portion 171. Each of the horizontal portions 172 defines a pivoting hole 1721 along a horizontal direction.

The printed circuit board 21 includes a top surface 211 and a bottom surface 212. The printed circuit board 21 includes a mating portion 213 at a front end and a connection portion 214 behind the mating portion 213. Both of the top surface 211 and a bottom surface 212 of the mating portion 21 defines a plurality of conductive pads 215 spaced arranged along the horizontal direction, for electrically connected with the mating connector (not shown). The connection portion 214 spaced defines a pair of positioning holes 2141 along the horizontal direction.

The inner-mold 5 includes a first portion 231 enclosing the conjunction portion of the printed circuit board 21 and the cable 4, and a second portion 232 forwardly extending from the first portion 231.

The fixing member 3 is made of insulative materials, and including a pair of positioning posts 31 and a base portion 32 connecting the pair of positioning posts 31.

The unlocking assembly 6 includes an actuator 61 with a z-shaped section in the front-to-back direction punched by a metal plate, a operating portion 62 and a pivot shaft 63. The actuator 61 structured in a pivotal manner, includes a vertical section 611 be of rectangular ring shape, a horizontal section 612 extending vertically forwards from a top end of the vertical section 611 and a connection section 613 extending vertically rearwards from a bottom end of the vertical section 611. The vertical section 611 includes a pair of edge section 6111 respectively expending from a left and right side thereof, to enhance the strength of the vertical portion 611. The vertical section 611 defines a rectangular opening 6112 on a middle portion thereof. The horizontal portion 612 includes two pivotal edges or edge regions 6121 respectively extending vertically upwards from a left and right side thereof, and an actuating piece 6122 extending forwardly from a front end thereof. A front end of the actuating piece 6122 locates in a plane parallel to and higher than a plane the horizontal portion 612 located. A rear end of the actuating piece 6122 is obliquely connected to a front end of the horizontal portion 612. A rear end of both pivotal edges 6121 defines a pivoting hole 6123. Each end of the pivot shaft 63 is passed through a pivoting hole 6123 and a corresponding pivoting hole 1721 of the horizontal portions 172, so that the actuator 61 is pivotally assembled on the insulative body 1. The operating portion 62 includes a pull belt 621 and a pull ring 622 set on a rear end of the pull belt 621. The pull belt 621 is formed on the outer periphery of the connecting section 613 to fixedly connect the actuator 61.

When assembling the plug connector assembly 100, firstly, the two printed circuit board modules 2 are stacked in the receiving room 18 of the insulative body 1 along the vertical direction; the positioning hole 2141 of the connection portion 214 are align with the through hole provided in the space plate 183 in the vertical direction; the fixing member 3 is assembled on the insulative body 1, by positioning posts 31 passing through the corresponding through holes of the space plate 183 and interference coordinating with the corresponding positioning hole 2141 of the printed circuit board 21, while the base portion 32 of the fixing member 3 is received in the slot 121 of the insulative body 1, thus the fixing member 3 fix the printed circuit board modules 2 in the insulative body 1. The actuator 6 of the unlocking assembly 6 are pivotally fixed between the mounting plates 17, and the vertical portion 611 is located at a rear side of the insulative body 1 and at a distance from the rear end surface 14 of the insulative body 1. The position of the pivoting hole 1721 of the mounting plate 17 is set so that the horizontal section 612 is away from the top surface 11 of the insulative body 1 while the front end of the actuating piece 6122 is pressed against a top side of the rear end of the pressing portion 152. The actuating piece 6122 abuts against the rear end of the pressing portion 152 and does not exceed the locking block 1531 forward. A front end of the cable 4 is passed through the rectangular opening 6112 of the vertical section 611 to being soldered on the corresponding conductive pads 215 set on the connection portion 214 of the printed circuit board 21. The first portion 231 and the second portion 232 of the inner-mold 5 are filled in the receiving room 18 to fix the joint between the printed circuit board 21 and the cable 4.

When the plug connector assembly 100 needs to be unlocked with the mating connector, the operator only needs to pull the operating portion 62 backward, and the operating portion 62 is relative rotated relative to the pivot shaft 63 with the actuator 61. When the actuating piece 6122 rotates downwards with the pivot shaft 63 as the center and applies a downward force on the pressing portion 152 of the latching apparatus 15, the latching portion 153 at a front end of the pressing portion 152 synchronously moves down so that the plug connector assembly 100 and the mating connector are unlocked. After the plug connector assembly 100 is completely disengaged from the mating connector, the pulling force applied to the operating portion 62 can be removed, and simultaneously the actuating piece 6122 rotates upwards with the pivot shaft 63 as a center and releases the pressure on the pressing portion 152 of the latching apparatus 15, so that the latching apparatus 15 returns to its original state.

The actuating piece 6122 of the plug connector assembly 100 according to the present invention is located on a top side of the insulative body 1, and the pull belt 621 of the operating portion 62 is located on a bottom side of the insulative body 1, and pulls the pull belt 621 can drive the actuator 6122 on the top side of the insulating body 1 to unlock the lock of the plug connector assembly 100 and the mating connector. Crossing the prior art, the stroke of the pull belt 621 of the present invention is small, and the pull belt 621 and the pull ring 622 are convenient to use. In addition, the cable 4 of the present invention can effectively terminate the actuation stroke of the actuator 61. Composed with the prior art, the stroke of the pull belt 621 of the present invention is small, and the pull belt 621 and the pull ring 622 are convenient to use. In addition, the cable 4 of the present invention can effectively terminate the actuation stroke of the actuator 61.

Figure 13:
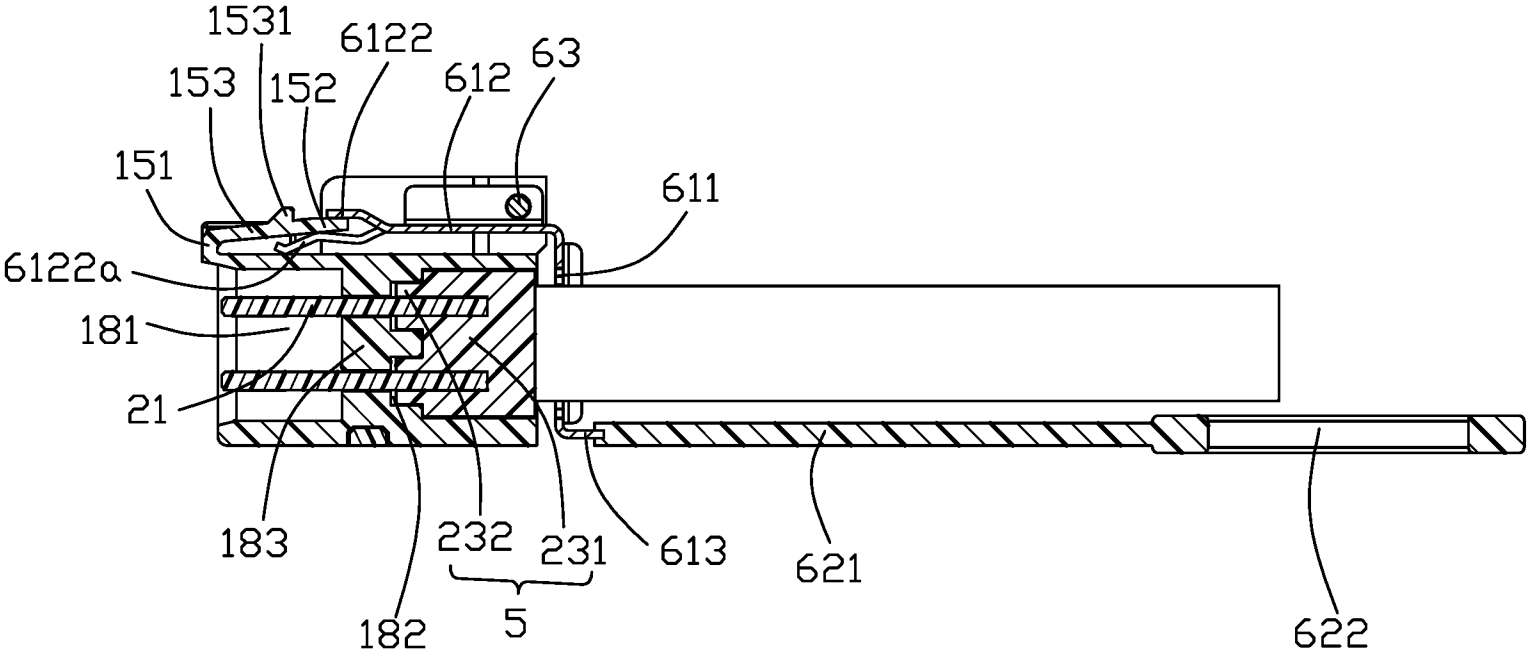
FIG. 13 is a section view of the plug connector assembly according to the third embodiment.

Referring to FIG. 8 to FIG. 12, in another embodiment of the plug connector assembly 100 according to the present invention, two opposite sides of a rear end of the first portion 231 respectively extends outward to form a stop block 2311. The width of a portion where the stop block 2311 is located in the left-right direction is greater than the width of other portions of the first portion 231. A step portion 2312 is formed between each stop block 2311 and the first portion 231. The step portion 2312 has an inclined front side, a top end of which is forward beyond a bottom end along the front-to-back direction. In the present embodiment, because two printed circuit board modules 2 are stacked in the vertical direction, the first portion 231 of the inner-mold 5 is also correspondingly configured as two parts of the top and the bottom. A top portion of the first portion 231 encloses the connection between one of the printed circuit board modules 2 and the cable 4, and a bottom portion of the first portion 231 covers the connection between the other printed circuit board module 2 and the cable 4. Each stop block 2311 is also correspondingly provided as top and bottom parts. Each step portion 2312 is also correspondingly provided as top and bottom parts. The front side of each step portion 2312 is also correspondingly provided as top and bottom parts. And a inclination angles of a top portion and a bottom portion of the front side remain the same, spaced apart and coplanar. FIG. 13 discloses a third embodiment of the invention wherein the actuating piece 6122 is split into two parts respectively located by opposite surfaces of the pressing portion 152, and the part 6122*a* is located under the pressing portion 152 and resiliently abutting against the top surface 11 of the insulative body 1. Therefore, the pressing portion 152 is essentially sandwiched between the actuating piece 6122 and the split/inner part 6122*a*, This arrangement may assure the pressing portion 152 to be located at the correct position even if the pressing portion 152 experiences over-deflection thereof.

In one feature of the present embodiment, the width of the rectangular opening 6112 along the left-to-right direction is smaller than the width of the first portion 231 where the stop block 2311 is located. When the operator pulls the operating portion 62 backward, the bottom end of the vertical section 611 is driven by the connection section 613 to rotate upwards with the pivot shaft 63 as a center, so that the vertical section 611 is stopped on the front sides of the stop blocks 2311 with the front end inclined forward. Since the front side of the stop blocks 2311 blocks the vertical section 611 of the actuator 61, the stroke of the vertical section 611 is restricted when the operator pulls the operating portion 62, so that deformation of the actuator 61 due to over operation can be avoided. Another feature of the invention is to have the latching portion 153 unitarily formed on the insulative body 1 rather than on the actuator 61 pivotally mounted upon the insulative body 1. Correspondingly, the actuator 61 is made from metal having superior strength thereof. Another feature of the invention is to have the connecting portion 151 located in front of the latching portion 153 so as to provide sufficient displacement for the latch block 1531, compared with the connecting portion located behind the latching portion in a hypothetical structure.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. A plug connector assembly comprising:

an insulative body defining a latch apparatus on a side thereof, the latch apparatus having a latching portion;

a cable extending along a front-to-back direction and rearwardly exposed to a rear end of the insulative body;

an unlocking assembly assembled on the insulative body and cooperating with the latch apparatus; wherein the unlocking assembly comprises an actuator assembled on the insulative body and an operating portion connected to the actuator, and when the operating portion is operated, the actuator is driven by the operating portion to apply a force on the latch apparatus to move the latching portion;

the unlocking assembly comprises a pivot shaft to pivotally fix the actuator on the insulative body, and when the operating portion is operated, the actuator is rotated relative to the pivot shaft; and the actuator is punched by a metal plate and has a z-shaped section in the front-to-back direction, and the actuator comprises a vertical section, a horizontal section extending forwards from a top end of the vertical section, and a connection section extending rearwards from a bottom end of the vertical section.

2. The plug connector assembly as described in claim 1, wherein the vertical section defines a opening on a middle portion thereof to allow the cable extending through the opening.

3. The plug connector assembly as described in claim 1, wherein the latch apparatus is integrally formed on a top side of the insulative body and extends upwards for a certain distance from a front edge of the insulative body and then extends backwards.

4. The plug connector assembly as described in claim 3, wherein the horizontal portion is pivotally fixed on a top surface of the insulative body, and the operating portion connects the connection section, and the actuator is rotated relative to the pivot shaft by driving of the operating portion, thus a front end of the horizontal portion moves to press the latch apparatus.

5. The plug connector assembly as described in claim 3, wherein the insulative body spaced defined a pair of mounting plate behind the latch apparatus along a horizontal direction which perpendicular to the front-to-back direction and the pivot shaft are fixed between the mounting plates along the horizontal direction.

6. The plug connector assembly as described in claim 3, wherein the latch apparatus comprises a connecting portion extending upwardly from a front end of the top surface, a pressing portion behind the connecting portion and the latching portion, and the latching portion connects between the connecting portion and the pressing portion, and the front end of the horizontal portion overlaps a top side of the pressing portion of the latch apparatus.

7. The plug connector assembly as described in claim 3, wherein the horizontal section comprises an actuating plate forwardly extending from a front end of the horizontal section, which overlaps the top side of the pressing portion, and the actuating plate is located on a plane parallel to and higher than a plane the horizontal section located.

8. The plug connector assembly as described in claim 3, wherein two sides of the front end of the pressing portion extend outward to form a wing portion.

9. The plug connector assembly as described in claim 2, wherein the plug connector assembly further includes a stopping assembly fixed relative to the insulative body, and the stopping assembly includes a stop block to restrict the stroke of the actuator.

10. The plug connector assembly as described in claim 9, wherein the stop block is disposed behind the vertical section, when the actuator is rotated relative to the pivot shaft, the stop block is stopped by the stop block.

11. The plug connector assembly as described in claim 10, further comprising an inner-mold enclosing a front end of the cable received in the insulative body, which rearwardly extends to expose to a rear end of the insulative body, and the stopping assembly is formed on an exposed rear end of the inner-mold.

12. The plug connector assembly as described in claim 11, wherein the rear end of the inner-mold is passed through the opening of the vertical section, and the stop block is formed on a side of the inner-mold extending outwardly and behind a rear side of the vertical section.

13. The plug connector assembly as described in claim 12, wherein the stop block defines an inclined front side to fit with the rear side of the vertical section.

14. A plug connector for latching with a mating connector, comprising:

an insulative body defining a latch apparatus on a side thereof with a deflectable latching portion having a latch block thereon for locking with the mating connector;

a cable extending along a front-to-back direction and rearwardly extending from a rear end of the insulative body; and an unlocking assembly being discrete from the insulative body, assembled on the insulative body in a pivotal manner, and associatively inwardly engaged with the latch apparatus; wherein the unlocking assembly includes an actuator pivotally assembled on the insulative body and an operating portion connected to the actuator;

the latching portion is deflected by the actuator, for unlocking the plug connector from the mating connector, in response to a rearward movement of the operating portion; and the insulative body forms a stop block in confrontation with the actuator in a front-to-back direction to prevent excessive rotation of the actuator.

15. The plug connector as claimed in claim 14, wherein said actuator further includes an inner part abutting a pressing portion of the latch apparatus.

16. The plug connector as claimed in claim 14, wherein said actuator is made from sheet metal and has a horizontal section and a pair of pivotal edge regions extending from two sides of the horizontal section so as to support a pivot shaft therewith.

17. A plug connector comprising:

an insulative body defining a latch apparatus on a side thereof, the latch apparatus having a deflectable latching portion with a latch block;

a cable extending along a front-to-back direction and rearwardly extending from a rear end of the insulative body; and an unlocking assembly being discrete from the insulative body, assembled on the insulative body in a pivotal manner, and associatively inwardly engaged with the latch apparatus; wherein the unlocking assembly includes an actuator pivotally assembled on the insulative body and an operating portion connected to the actuator;

the latching portion is deflected by the actuator, for unlocking the plug connector from the mating connector, in response to a rearward movement of the operating portion; and the unlocking assembly includes a pivot shaft, and the actuator is made from sheet metal and has a horizontal section, the horizontal section having a pair of pivotal edge regions to couple to the pivot shaft.

* * * * *